US011585615B2

(12) United States Patent
Geppert et al.

(10) Patent No.: US 11,585,615 B2
(45) Date of Patent: Feb. 21, 2023

(54) TUBE LANCING MACHINE

(71) Applicant: Acconda LLC, Dickinson, TX (US)

(72) Inventors: Christian Geppert, Dickinson, TX (US); Stefan Schroth, Wiesbaden (DE)

(73) Assignee: Acconda LLC, Dickinson, TX (US)

( * ) Notice: Subject to any disclaimer, the term of this patent is extended or adjusted under 35 U.S.C. 154(b) by 108 days.

(21) Appl. No.: 17/184,937

(22) Filed: Feb. 25, 2021

(65) Prior Publication Data

US 2021/0270550 A1 Sep. 2, 2021

Related U.S. Application Data

(60) Provisional application No. 62/982,367, filed on Feb. 27, 2020.

(51) Int. Cl.

| | |
|---|---|
| ***F28G 3/16*** | (2006.01) |
| ***B08B 9/032*** | (2006.01) |
| ***F28G 15/04*** | (2006.01) |
| ***F28G 15/02*** | (2006.01) |
| ***B08B 9/043*** | (2006.01) |
| ***B08B 9/045*** | (2006.01) |

(52) U.S. Cl.

CPC ..... *F28G 3/163* (2013.01); *B08B 9/0321* (2013.01); *B08B 9/045* (2013.01); *B08B 9/0433* (2013.01); *F28G 15/02* (2013.01); *F28G 15/04* (2013.01)

(58) Field of Classification Search

None

See application file for complete search history.

(56) References Cited

U.S. PATENT DOCUMENTS

| | | | | |
|---|---|---|---|---|
| 2016/0096202 | A1* | 4/2016 | Zink | B08B 3/02 134/179 |
| 2018/0266777 | A1* | 9/2018 | Krauser | F28G 1/163 |
| 2020/0056851 | A1* | 2/2020 | Watkins | B65G 43/04 |

* cited by examiner

*Primary Examiner* — Eric W Golightly

(74) *Attorney, Agent, or Firm* — Jones Day

(57) ABSTRACT

A machine comprising: a lance, the lance configured to clean insides of tubes; a guide way positioned near the tubes; a transversal drive support slidable on the guide way and configured to move the lance along the guide way towards an insertion head; a rotational drive coupled to the lance for controlling rotation of the lance; and a feeding system coupled to the lance, wherein the guide way forms at least one supporting lance channel over a length of the guide way, the at least one channel forming an enclosure from all sides for guiding the lance, whereby a part on the circumference of the enclosure is made of a flexible lip, which lip can be locally bent by deflectors travelling with the lance.

20 Claims, 19 Drawing Sheets

TUBE LANCING MACHINE

CROSS-REFERENCE TO RELATED PATENT APPLICATIONS

This application claims the benefit of the filing date of U.S. Provisional Application Ser. No. 62/982,367, filed Feb. 27, 2020, which is hereby incorporated by reference in its entirety herein.

FIELD OF THE DISCLOSURE

This disclosure relates generally to the field of apparatus for cleaning the inside of tubes in straight-tube type heat exchangers and, in some embodiments, to a twin, rigid lance machine.

BACKGROUND

When pushing rotating thin, long lances into heat exchanger tubes, they would buckle and risk damages if they were not supported in the radial direction. In a rigid, twin lance machine, a pair of parallel metal lances are driven by a transversal drive into and out of heat exchanger tubes. The lances are supported by a plurality of spaced apart, retractable door supports so that the transversal drive mechanism can approach the tube of the heat exchanger as closely as possible. A pair of rotational drive motors rotates the lances at a user controllable speed. As the lances are moved into the tubes, the interlocked support doors retract one at a time, sequentially, to prevent uncontrolled transverse movement of the transversal drive. Similarly, as the lances are withdrawn from the tubes, the support doors close one at a time in an interlocked fashion.

The pushing force onto the lances is conveyed via the rotational drive of the lances and as a result an important number of guiding elements is desirable to minimize the unsupported distance between the guide elements. Dealing with the various solutions for moving the guide elements out of the way of the rotational drive or pushing them together until they form a single block cause all sorts of maintenance and operational issues, which delay the actual tube cleaning process, while performing the cleaning project. Furthermore, there will always remain a certain free length between the guide blocks, which will allow a lance to buckle, when the guide blocks become knots for a rotating lance forming a wave.

Shortcomings mentioned here are only representative and are included simply to highlight that a need exists for improved lancing devices. Embodiments described herein address certain shortcomings but not necessarily each and every one described here or known in the art. Furthermore, embodiments described herein may present other benefits than, and be used in other applications than, those of the shortcomings described above.

SUMMARY

A tube lancing machine (e.g., for lancing heat exchanger tubes) that allows a better guiding of the lances from the rotational drive to the entry in the tubes is provided in embodiments of this disclosure. The lancing machine may include one, two, three, four or more lances. For example, in some embodiments, the lances are continuously supported in radial direction by being guided in a narrow channel. Each channel has one solid bottom and two solid sides. The top of each channel is covered by a rubberlike lip, for instance a semi-flexible PU sheet. As used in this disclosure, the term "flexible" or "semi-flexible" means able to bend far enough for the application described herein without breaking. Due to the narrow guiding surfaces in the channel it is possible to use more flexible high-pressure hoses as lances, which will not buckle though there might be severe advancing forces. It is an advantage for guiding purposes, if the width of the supporting lance channel is less than four (and possibly less than three) times the maximum outer diameter of a lance comprising (e.g., made of) metal and less than three (and possibly less than two) times the maximum outer diameter of a lance comprising a flexible hose. This opens several new and helpful handling applications. An inserting head coupled to the end of the two channels can be executed as a tube indexer for adjusting the lateral distance of the lances to the lateral distance of two tubes. Furthermore, by having an intermediate section between the channels and the inserting head with flexible guiding hoses for the flexible lances, the guide way must no more be precisely placed at the height and in the direction of the heat exchanger tubes.

Depending on the bending properties of the flexible lance, it can be directly coupled to a high-pressure feeding tube of a rotational drive, which is transversally connected to the transversal drive and which is riding slidable on the guide way and directed at a flat angle $\alpha$ to the bottom of the channel, whereby the lance pushes the lip upwards to enter the channel. For the reduction of the rotational friction, which is generated by the bending forces at the entrance into the channel, a second embodiment shows a lance anchor fixed to a lance anchor carriage and carrying a rotatable axially captured tube, which may rotate with the lance.

Another embodiment avoids the bending of lances at the entry to the channel by introducing a lance anchor carriage riding slidable on the guide way, pushing the lip upwards and carrying a lance anchor in the channel, which has a rotatable, axially captured connector tube. The lance anchor carriage is transversally coupled to the transversal drive to transmit the advance forces to the captured connector tube. At one side, the flexible lance is solidly coupled to the rotatable axially captured connector tube, such that the connector tube takes the advance forces from the transversal drive. The flexible lance receives the advance forces, the torque moment and the high-pressure liquid from the connector tube while in a narrow straight channel to prevent the flexible lance from buckling. This allows use of a rather flexible lance, which due to its flexibility gives much more freedom for the use of an intermediate section with guiding hoses to an extent that the direction of the heat exchanger tubes and the direction of the channels may deviate by several tens of degrees. At the other side, the rotatable axially captured connector tube is solidly connected to the inclined rotational drive by a bendable connecting hose, which is not exposed to the advance forces, and therefore has mainly been selected for its bending properties at an angle $\alpha$ towards the bottom of the channel. This embodiment can be used with a continuous horizontal rubberlike lip along the channel, with horizontal spaced apart lip stripes, or with vertical spaced apart lip stripes. A comparison shows the function and the advantages of these different lips.

Another embodiment to avoid bending of the lance at the entry to the channel can be realized when a lance anchor with a rotatable, axially captured connector tube is directly attached to the transversal drive. At one side the lance is solidly coupled to the rotatable captured tube and at the other side to a flexible hose, which in a loop is coupled to an outside rotational drive (i.e., a rotational drive positioned outside of the track such that it does not move transversely along the track with the transversal drive (e.g., is stationary)) and which must have the length of the lance when drawn into the channel. It is understood that the embodiments disclosed herein, due to the mechanical properties of flexible high-pressure hoses, may also be applied to lances with a drill tip and flushing liquid.

Some of the embodiments described herein include a lance comprising a flexible hose, which permit the machine to interface with remote indexing units. Such embodiments advantageously permit the machine to clean, for example, heat exchanger pipes, while occupying a minimal amount of space and without requiring the use of scaffolding and other large infrastructure equipment. Additionally, such embodiments permit the full or near-full length of the guide way guiding the lance (minus the length of the drive units) to be used for moving the lance back and forth in contrast to, for example, tube clean machines that include complex guide elements that block a length of the guide way available for movement of the lance. Such machines having complex guide elements may require longer lances to clean the same length tubes as embodiments described herein that may comprise a lance having a flexible hose. Such embodiments also do not require an intermittent support structure along the length of the lance that may cause or contribute to the lance failing (e.g., via buckling). For example, embodiments described herein may comprise a lance with a flexible hose that permits the machine to push the lance with high forces (e.g., using a drill bit on the tip of the lance) that may cause more rigid lances to fail (e.g., via buckling).

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 1:
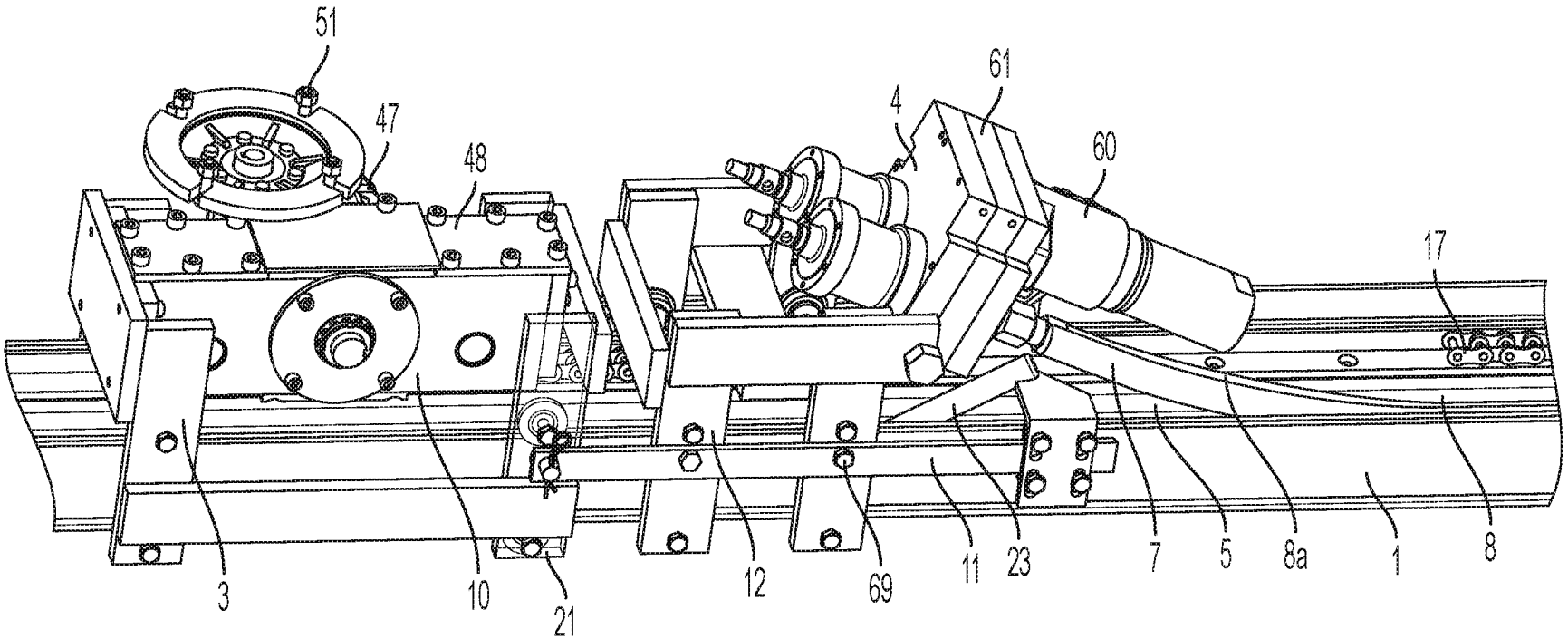
FIG. 1 is a schematic perspective view of a first embodiment of a guide way with a transversal drive support and with a rotational drive carriage.

FIGS. 1, 2A, 2B, 3 and 4 depict a first embodiment of a tube lancing machine in accordance with the present invention. In FIG. 1, an axial drive support 3 and a rotational drive carriage 12 are clamped by rollers 21 to the upper track 43 and to the lower track 42 for axial displacement. A connection piece 11 screwed by screws 69 to the rotational drive carrier 12 transfers the axial movement to the rotational drive carrier 12 and to a deflector 23. A chain 17 is fixed over the length of the guide way 1 and lying on the clamping bar 44. A rotational drive 4 is pivotably provisioned on the rotational drive carrier 12 transferring a rotational movement generated by an air motor 60 and a gear box 61 to a lance 7. The lance is directed into the channel 5 pushing the flexible lip 8 upwards during advance. As the lip closes the channel 5 after the deflector 23 has passed, the deflector 23 is also diving but towards the rear side of the channel 5 (i.e., the side closest to rotational drive carrier 12) for pushing the lip upwards during retraction. A transversal drive 10 fixed to the transversal drive support 3 has a gear box 48, and an angular gear 47 with a fixation 51 for an air motor.

Figure 2A:
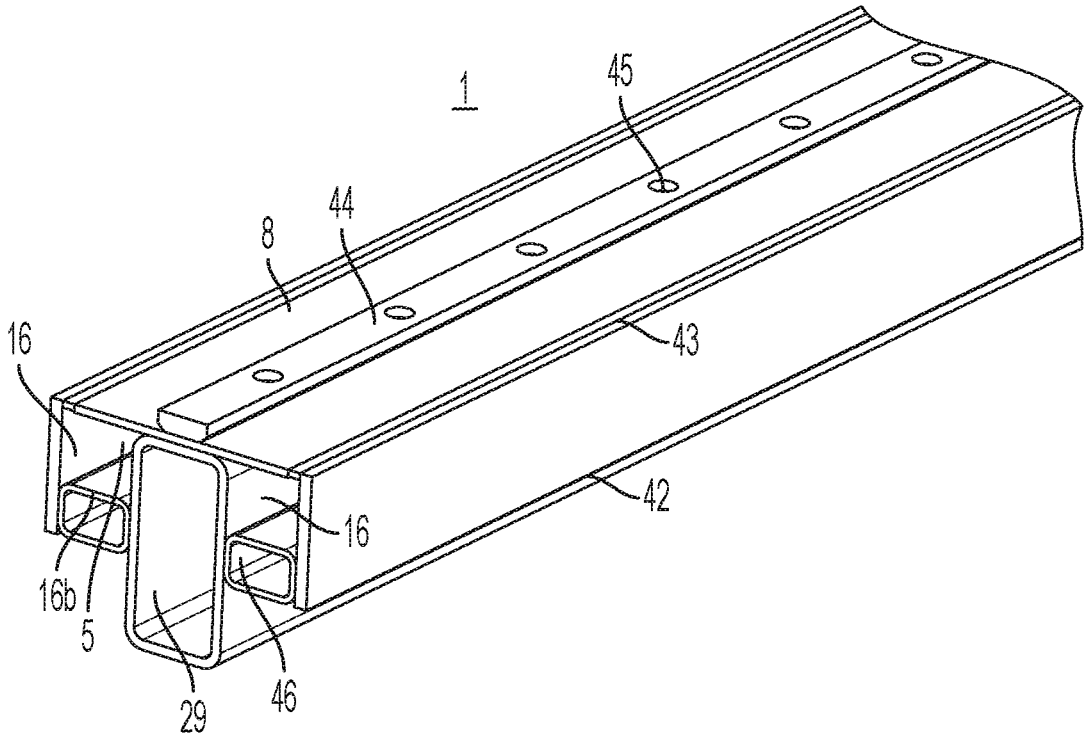
FIG. 2A is a schematic perspective view of the guideway in FIG. 1 with two supporting lance channels and a continuous horizontal lip.

FIG. 2A illustrates the structure of a guideway 1 with a main profile 29 and two welded on profiles 46 for building an inner side wall 16 and a bottom wall 16*b* of a channel 5. The outer sidewalls are welded to the profiles 46 to form a U-shaped channel 5, which is covered by a rubberlike lip 8 made of a polyurethane sheet. The lip 8 positioned over both channels 5 is held down by a clamping bar 44 and screws 45. The outer sidewalls serve as lower track 42 and upper track 43 for axially displaceable components (e.g., axial drive support 3 and rotational drive carriage 12).

Figure 2B:
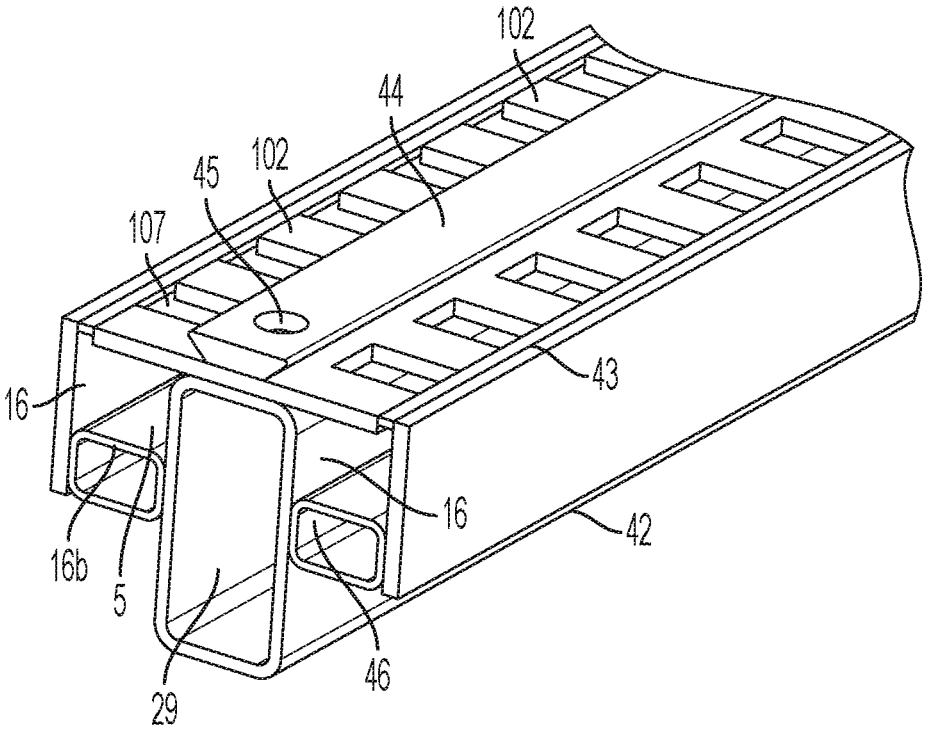
FIG. 2B is a schematic perspective view of the guideway in FIG. 1 with two supporting lance channels and with horizontal spaced apart lip stripes.

FIG. 2B shows an alternative embodiment of the guideway 1 as in FIG. 2A, where the lip 8 has incisions 107, which generate horizontal lip stripes 102. The horizontal lip stripes are spaced apart to make them independent from each other during the vertical bending.

Figure 2C:
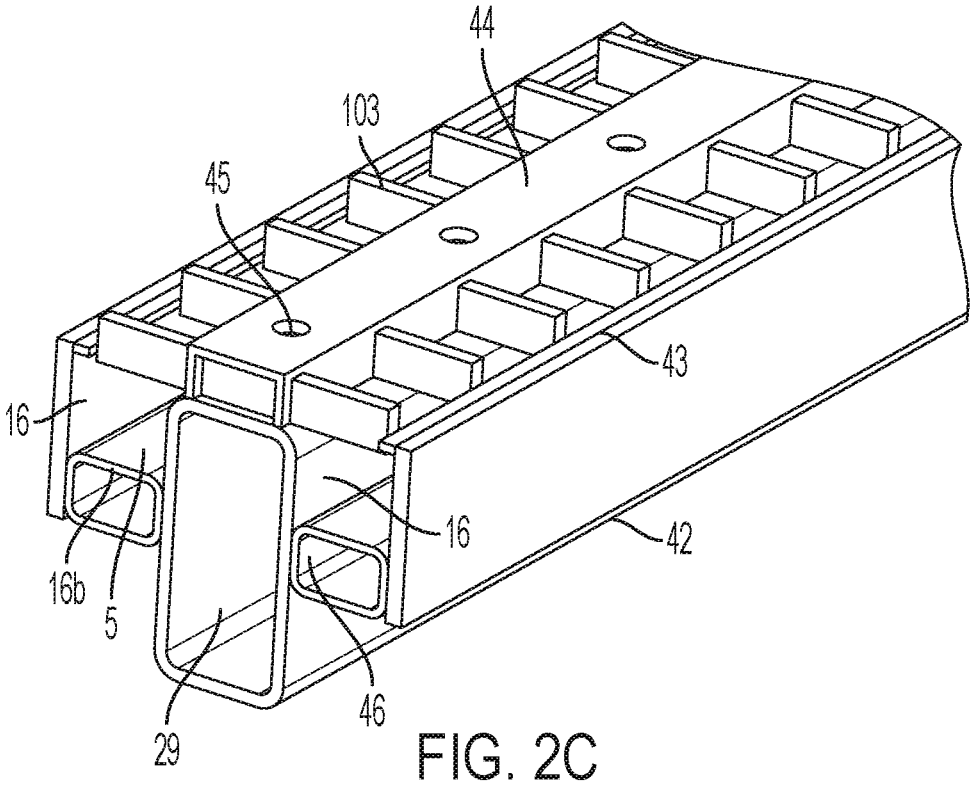
FIG. 2C is a schematic perspective view of the guideway in FIG. 1 with two supporting lance channels and with vertical spaced apart lip stripes.
Figure 16A:
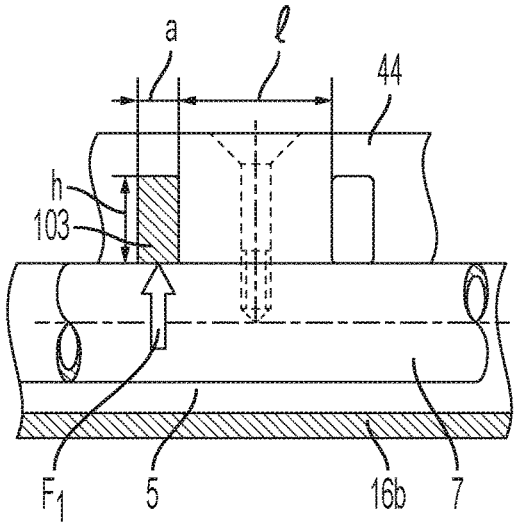
FIG. 16A is a schematic sectional side view of a vertical lip stripe in contact with the lance.
Figure 16B:
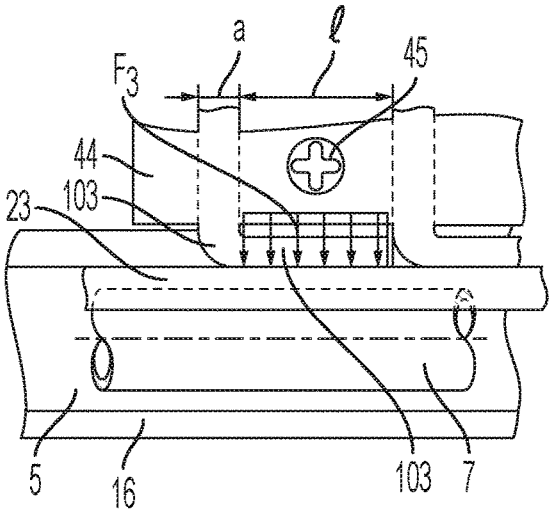
FIG. 16B is a schematic sectional top view of a vertical lip stripe, which is bent horizontally and in contact with a deflector.

FIG. 2C shows an alternative embodiment of the same guideway 1 as in FIG. 2B, where vertical lip stripes 103 are spaced apart and clamped by an adapted clamping bar 44 and screws 45. These vertical lip stripes 103 are bent horizontally as shown in FIG. 16B for opening the channel 5.

Figure 3:
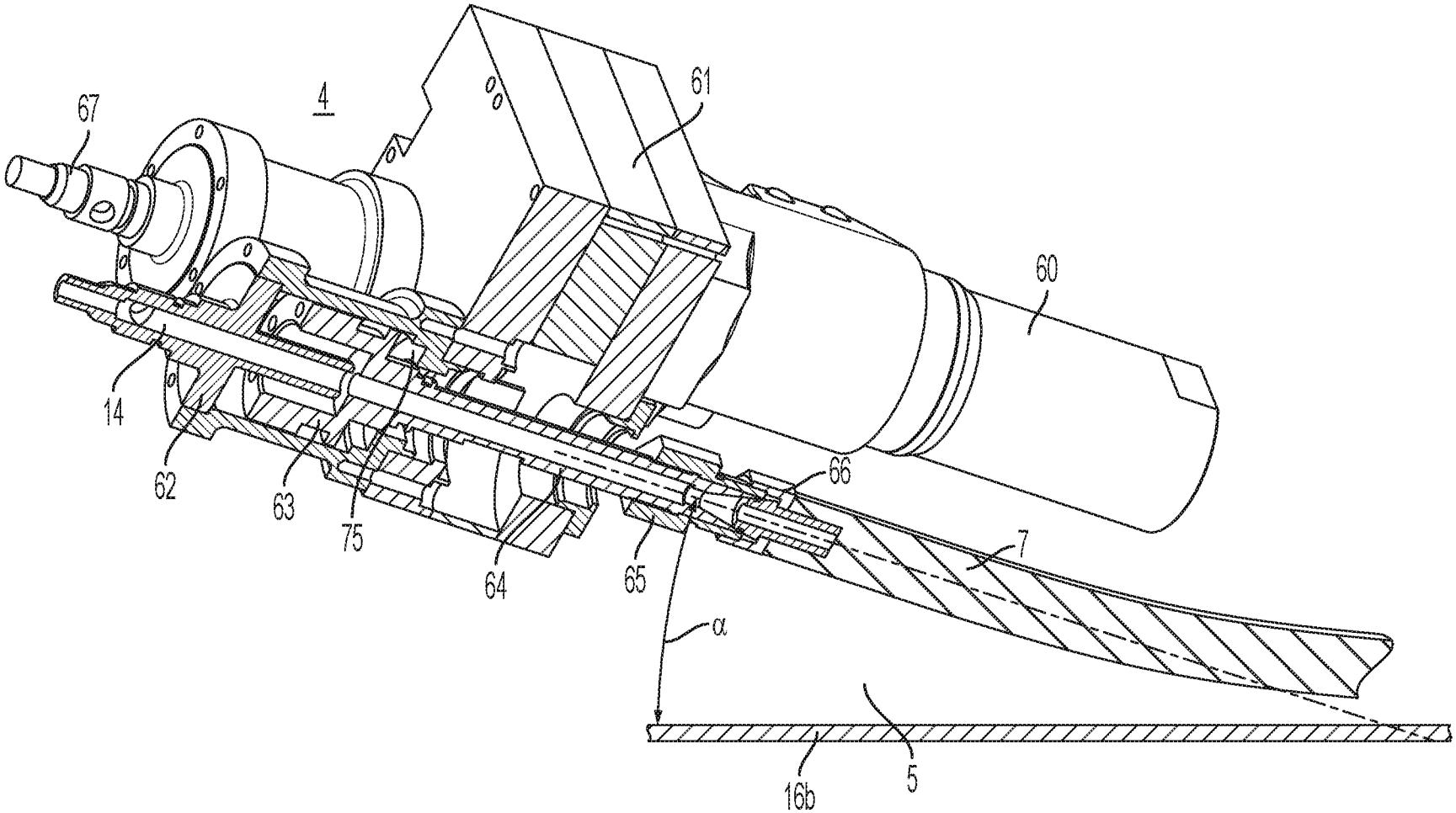
FIG. 3 is a schematic perspective view in section of the rotational drive in FIG. 1 coupled with a flexible lance and inclined toward the bottom wall of a supporting lance channel.

FIG. 3 shows details of the rotational drive 4, which is combined with a high-pressure water supply for a flexible lance 7. A mechanical seal 75 keeps the rotational part dry from the liquid part. High-pressure liquid 14 enters at a stationary tube connection 67 a non-rotating hollow shaft 62 and continues the flow through a swivel 63 into a rotating shaft 64 which is inclined by an angle $\alpha$ to the bottom wall 16*b* of the supporting lance channel 5. The rotating shaft 64 has an end piece 65 with a camlock connection 66 to a lance 7, which must be bent to follow the direction of the channel 5.

Figure 4:
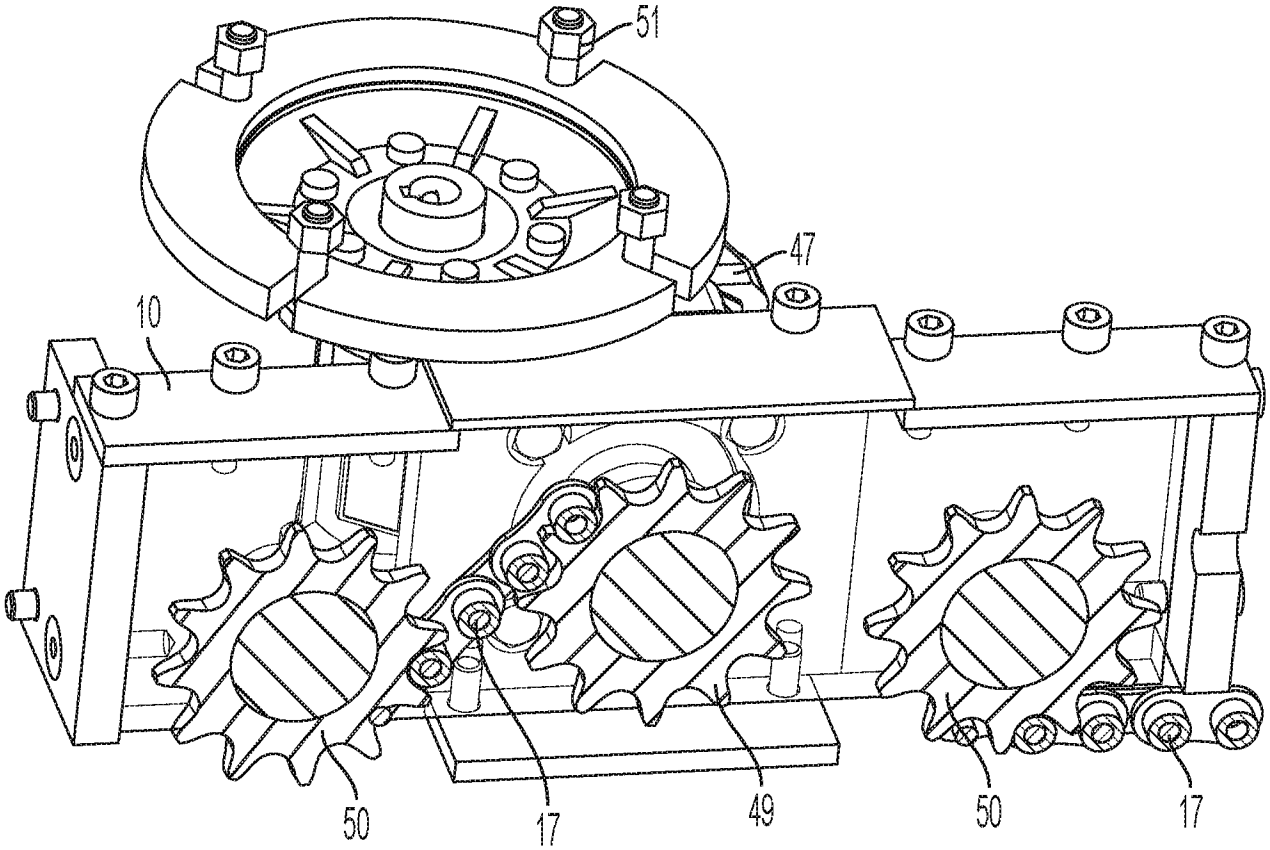
FIG. 4 is a schematic perspective view in section of the transversal drive in FIG. 1.
Figure 8:
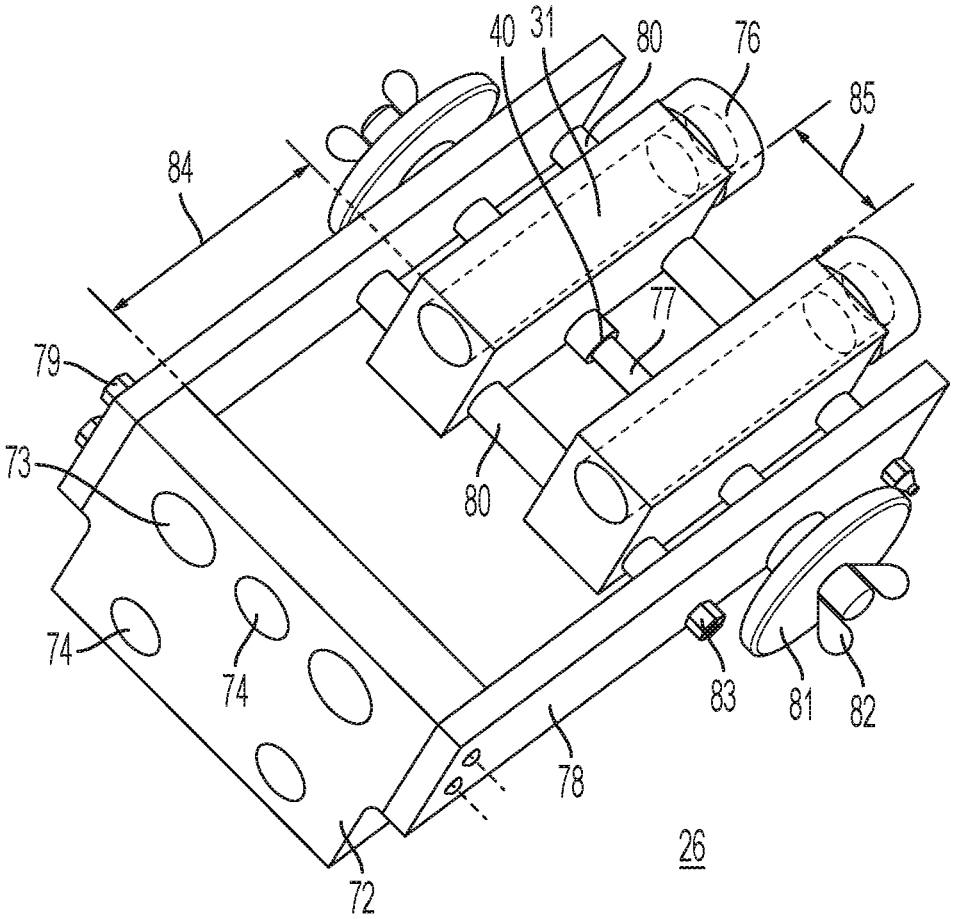
FIG. 8 is a schematic perspective view of an inserting head, which acts as a tube indexer for the shown embodiments with two lances.

In FIG. 4, for the transversal drive 10 the axially fixed chain 17 is led in a loop over a gear wheel drive 49 by diverting gears 50 for pulling the transversal drive support 3 along the guide way 1. All embodiments have an inserting head 26 which is built as tube indexer 40 in FIG. 8. An endplate 72 with guiding holes 73 for the two lances and fixation holes 74 for attachment is screwed with screws 79 to side plates 78, which are also connected by guide bars 80 and screws 83. Two tubular guiding blocks 31 are riding sideways displaceable on the guide bars 80. A threaded turnbuckle rod 77 acts on the guiding blocks 31 by means of a hand wheel 81 and wing nuts 82 at each side plate 78 for changing a lateral distance 85 between two end pieces 76. These are exchangeable for different sized lances. Each lance may be positioned through a guiding hole 73 and the corresponding hole in a guiding block 31 and coupled end piece 76. The holes 73 are aligned with channels 5, such as channels 5, of a guideway, such as guideway 1, and the end pieces 76 are aligned with tubes of a to-be-cleaned heat exchanger. Between the guiding holes 73 and the guiding blocks is a space 84, which gives enough room to shift the lances 7 sideways. In some embodiments, the lance(s) may form an "S" or other curved shaped in space 84, as needed to accommodate the axial offset between holes 73 and end piece 76.

Figure 5:
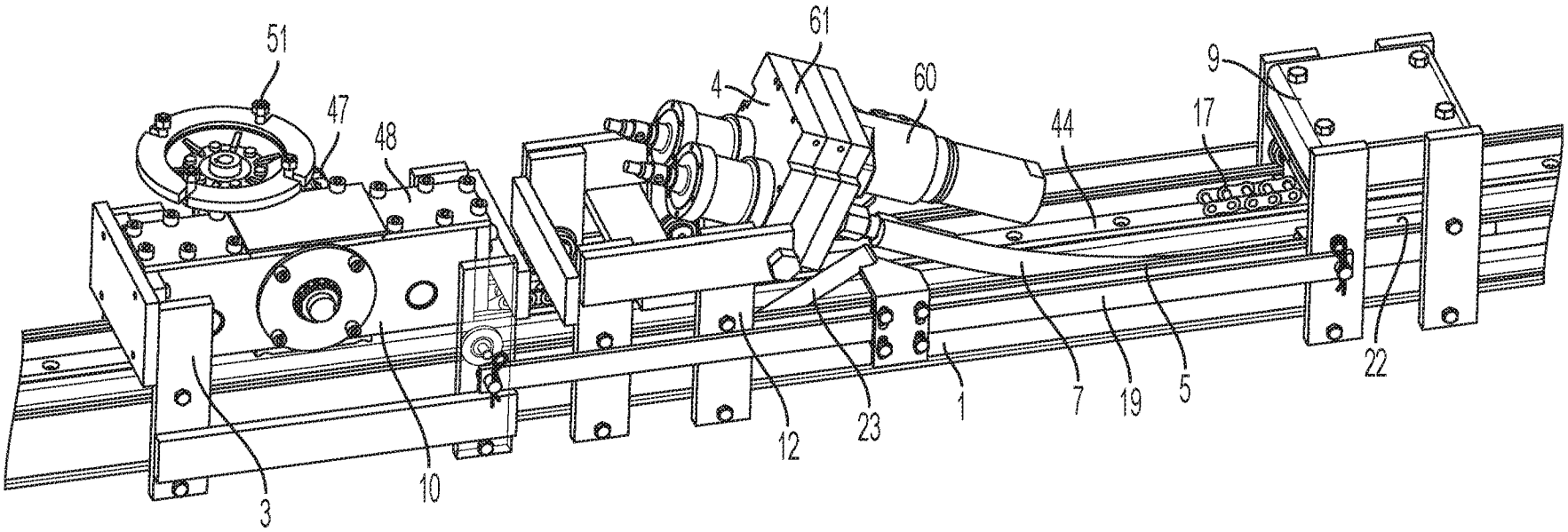
FIG. 5 is a schematic view of a second embodiment with the guide way, the transversal drive and with the rotational drive of FIG. 1, which is coupled to a lance anchor carriage.
Figure 6A:
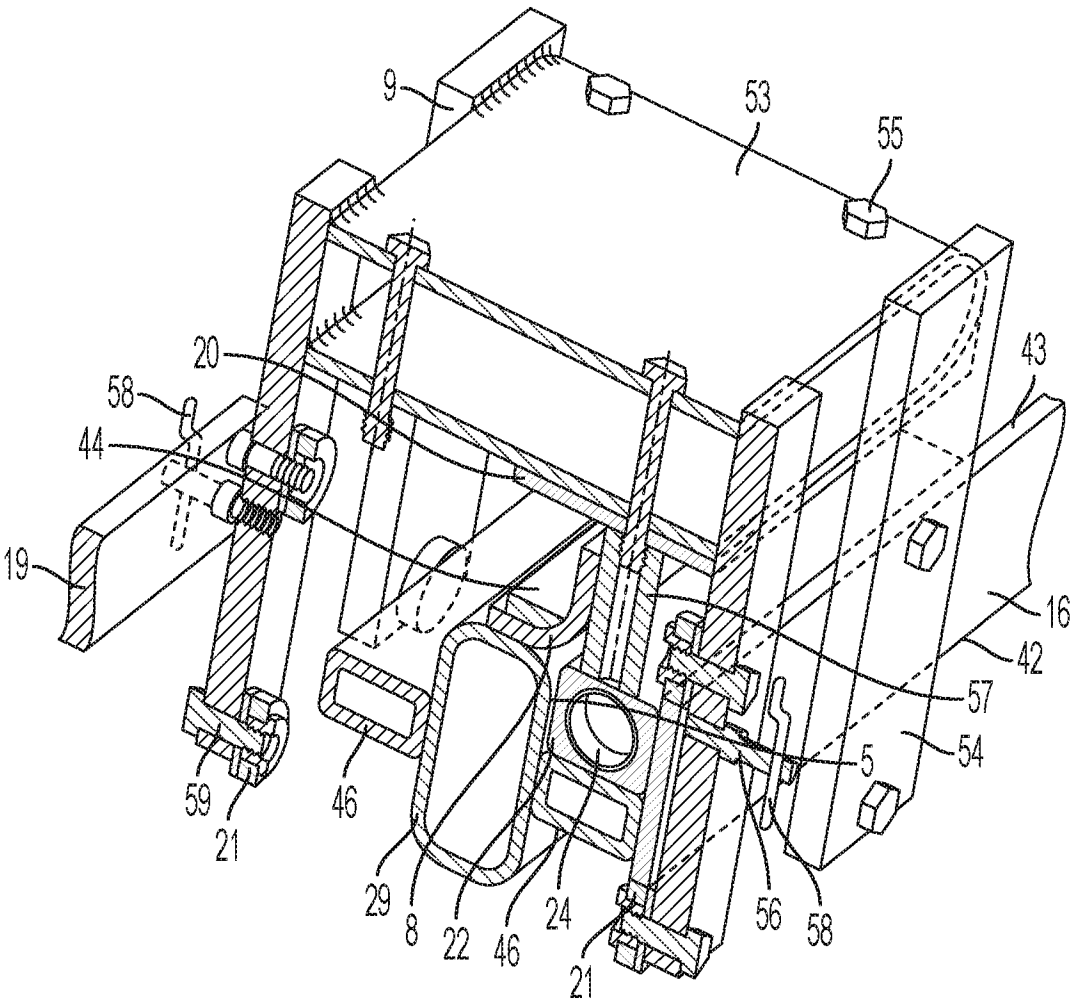
FIG. 6A is a schematic perspective view in section of the lance anchor carriage in FIG. 5 bearing a lance anchor deflecting a horizontal lip.
Figure 7A:
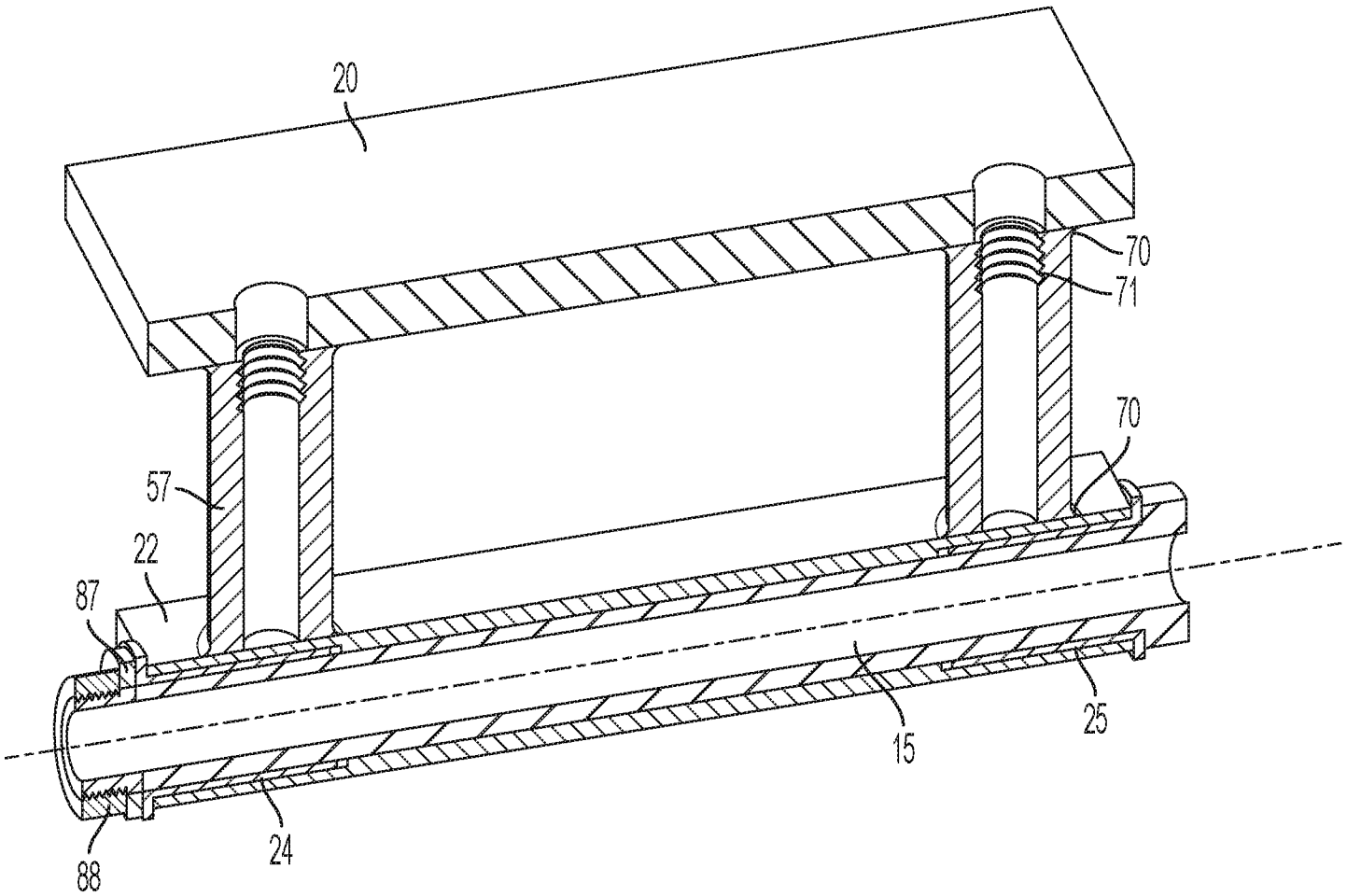
FIG. 7A is a schematic perspective view in section the lance anchor in FIG. 6 bearing a rotatable supporting tube for a lance.

A second embodiment is shown with FIGS. 5, 6A and 7A, where the difference to FIG. 1 is a new component, a lance anchor carriage 9 bearing a lance anchor 22 and being connected to the transversal drive support 3 by a transversal coupling bar 19 at a distance that a flexible hose lance 7 can bend during rotation. The lance is led through an axially captured and rotatable tube 15 (see FIG. 7A) rotating with the lance and reducing the rotational friction forces, which are generated with the bending of the lance. The lance anchor 22 in FIG. 7A consists of a square beam welded to two columns 57, which are welded to a platform 20 and which have a thread 71 for fixation to the lance anchor carriage 9. Bearings 24, 25 keep the tube 15 rotatable and axially captured. A nut 88 and a bearing ring 87 serve for assembly and for disassembly.

FIG. 6A shows some details of the lance anchor carriage 9. A section of a hollow profile 53 is welded to two posts 54 at each side which have upper and lower rollers 21 for gliding on the upper track 43 and on the lower track 42. Bearings 59 keep the friction in the rollers low. The profiles 29, 46 and the outer side walls 16 create the channel 5, where the lance anchor 22 with bearing 24 is visible. The lip 8 clamped between main profile 29 and clamping bar 44 is held upwards by columns 57. Though not depicted in FIG. 6A (for visual clarity of other depicted features), an identical second channel 5, or further additional (e.g., third, fourth) channels, is also formed by profiles 29, 46 outer side wall 16, and a portion of lip 8 (that is also not depicted for clarity), where another lance anchor 22 with bearing 24 may be positioned. Screws 55 fix the platform 20 to the lance anchor carrier 9. Loosening these screws 55 and rolling the lance anchor carriage 9 aside gives easy access to the lance anchor 22. The transversal coupling bar 19 is secured by a pin 58.

Figure 6B:
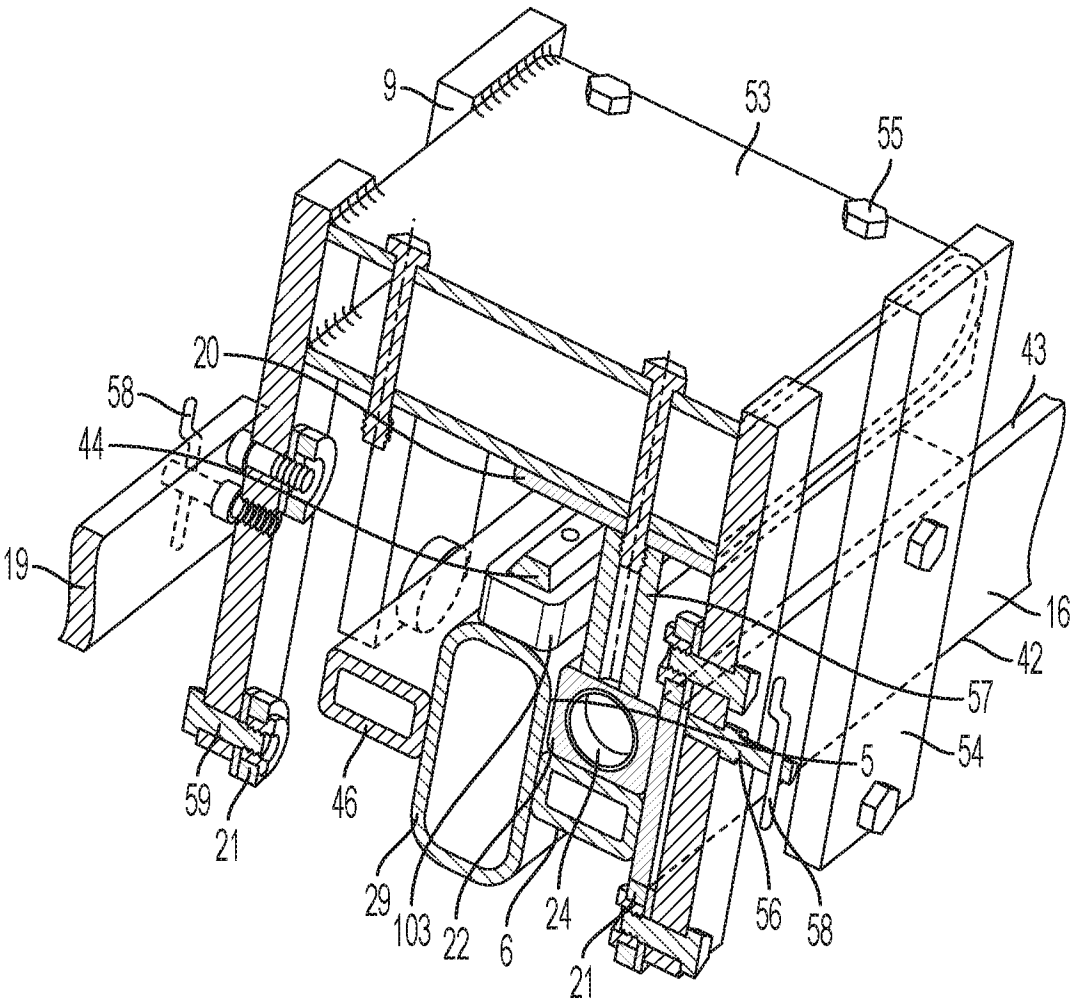
FIG. 6B is a schematic perspective view in section of a lance anchor carriage bearing a lance anchor deflecting a vertical lip stripe.
Figure 18:
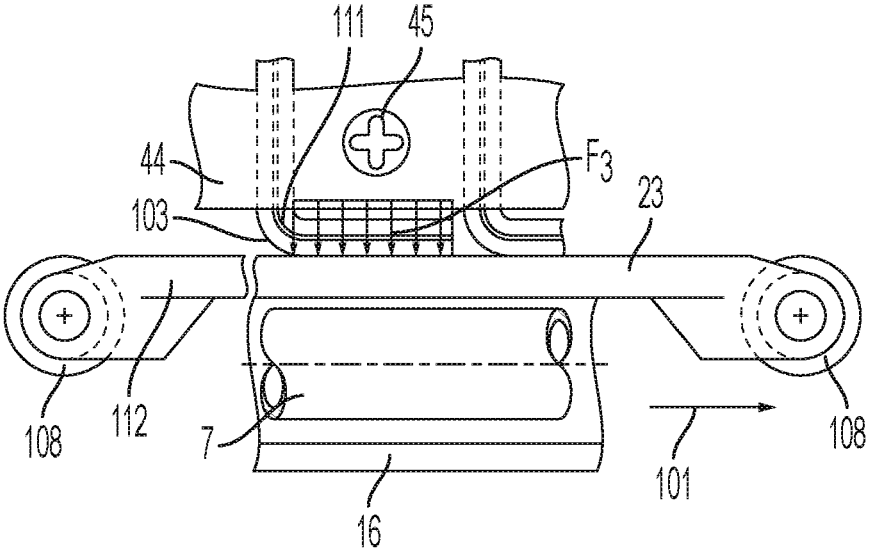
FIG. 18 is a schematic sectional top view of a deflector with diverting roles at his ends.

FIG. 6B is similar to FIG. 6A. It shows the same arrangement, while the horizontal lip 8 has been replaced by vertical lip stripes 103. The clamping of the spaced apart lip stripes 103 is shown in FIG. 2C. The vertical lip stripes 103 are bent in advance direction 101 (see FIG. 18) by columns 57 of the lance anchor 22. In FIG. 18 the vertical lip stripes 103 are held back by a guiding wall 112 in the area, where the connecting hose 6 emerges from the supporting lance channel 5. The deflector 23 has a frontal diverting roller 108 in advance direction 101 for initial horizontal bending of the vertical lip stripes. Upon continued movement in advance direction 101, the vertical lip stripes 103 slide along the guiding wall 112. The diverting roller 108 is positioned, where the connecting hose 6 is still in the channel 5. The guiding wall is ending, where the connecting hose 6 is completely emerged close to the rotational drive 4 with a diverting roller 108 or with a diverting profile under the connecting hose 6 or more backwards for diverting the vertical lip stripes 103 during retraction of the lance.

Figure 7B:
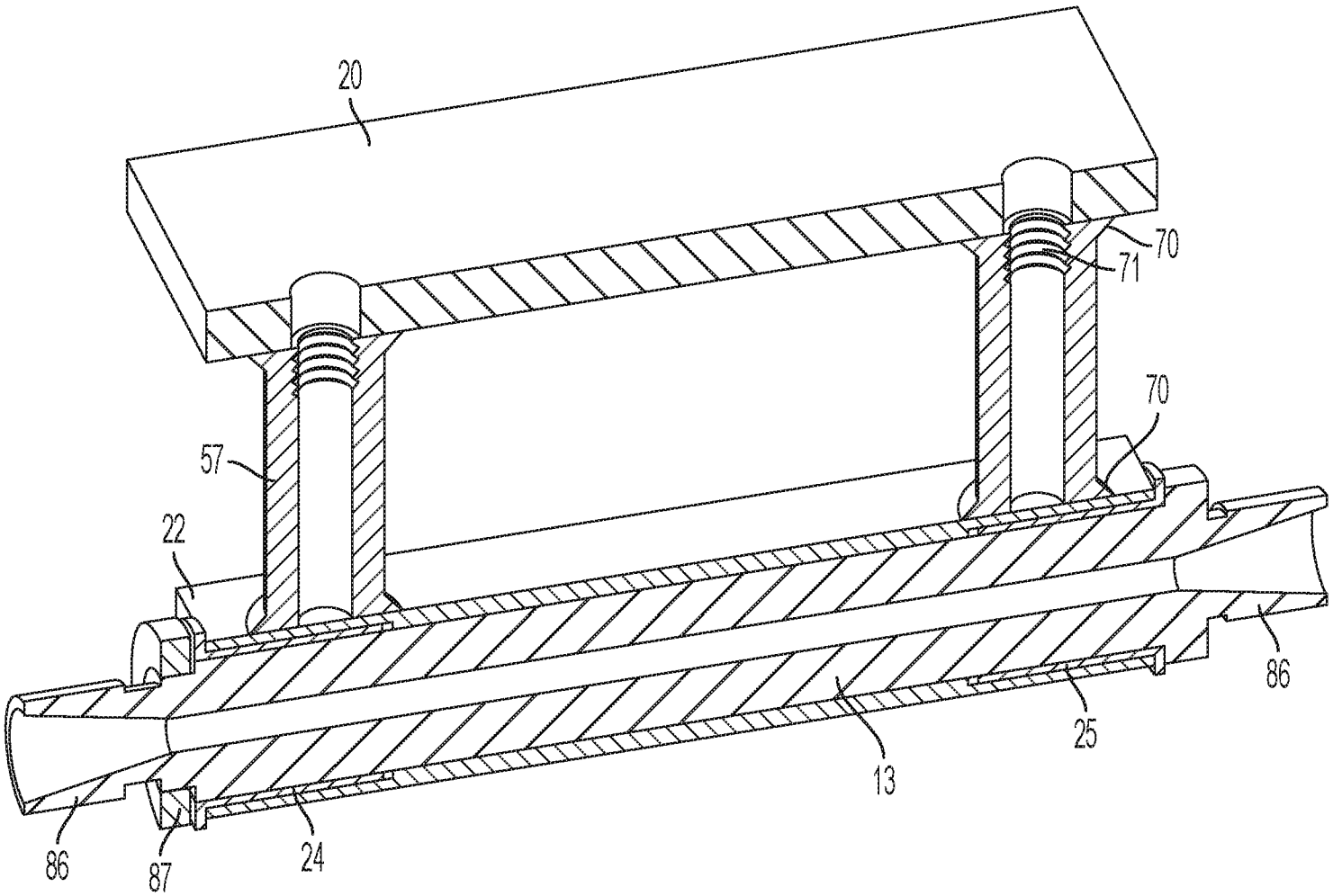
FIG. 7B is a schematic perspective view in section of the lance anchor of FIG. 6 bearing a rotatable and axially captured connector for a preferred third embodiment, where the connection to the lance is in the channel and the properties of the lance can be selected according to its behavior in the narrow channel.
Figure 9:
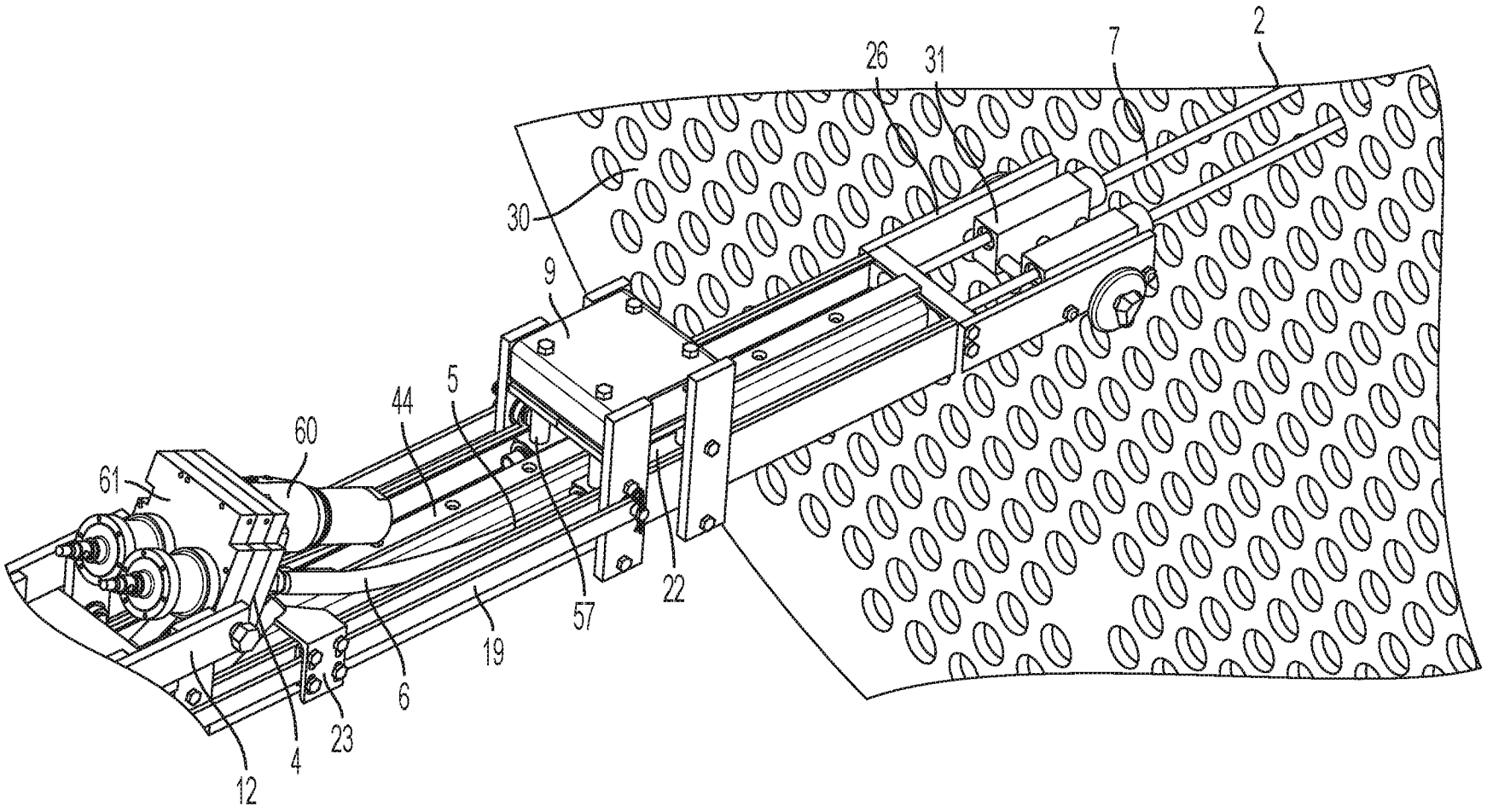
FIG. 9 is a schematic and perspective view of the embodiment of FIG. 5 with the lance anchor of FIG. 7B and with the tube indexer of FIG. 8 at a heat exchanger.

In a third embodiment the lance anchor of FIG. 7A is replaced by a lance anchor 22 of FIG. 7B, having bearings 24, 25 with a rotatable axially captured connector 13 which has a forward camlock fixation 86 for metal lances 7 as well as for flexible tube lances 7, where at the rear side there is a camlock fixation 86 for a short, flexible high-pressure hose 6 (see FIG. 9) coming from the rotational drive 4. For this third embodiment any of the carriage of FIG. 6A with a continuous horizontal lip 8 (FIG. 2A) or horizontal lip stripes 102 (FIG. 2B) or the carriage of FIG. 6B with vertical lip stripes 103 (FIG. 2C) can be used. In FIG. 9, the lance anchor 22 and the lance anchor carriage 9 are close to the inserting head 26 which guides two metal lances 7 with the guide blocks 31 into the tubes 2 of a heat exchanger 30. If flexible high-pressure hoses are used as lances 7, an intermediate section 35 with flexible guide hoses 34 can be used between an exit 32 of the supporting channels 5 and the tube indexer 40, as shown in FIG. 10.

Figure 10:
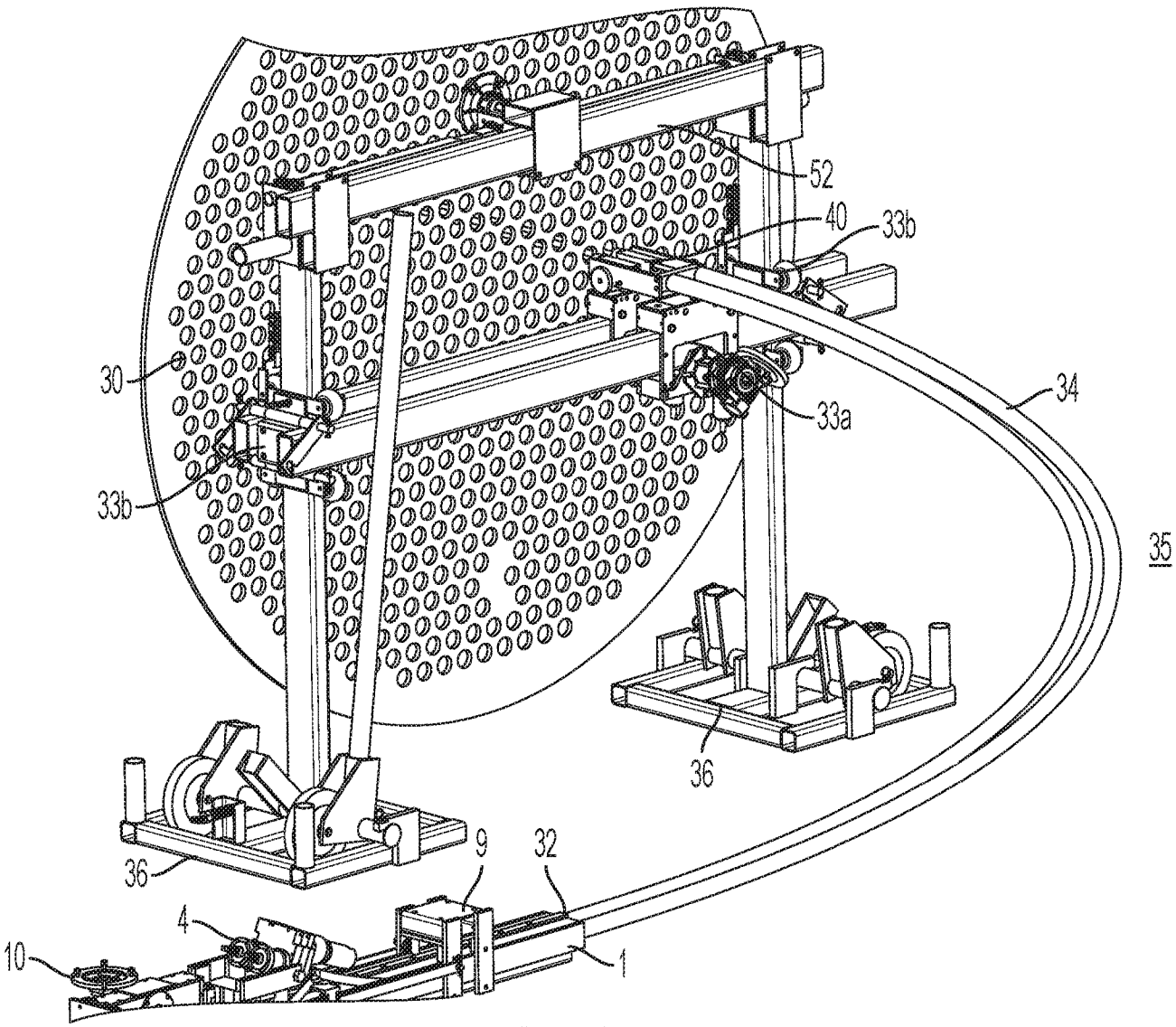
FIG. 10 is a schematic perspective view of the embodiment of FIG. 9 with flexible tube lances and with an intermediate section of flexible guiding hoses between the end of the channels and the tube indexer, which is coupled to indexer units at a heat exchanger.

In FIG. 10, the lance anchor carriage 9 on the guide way 1 is also close to the exit 32 of the channels 5. Flexible guiding hoses 34 are attached to the exit 32 of the channels 5 and to the tube indexer 40, which is attached to a horizontal indexer unit 33*a* riding on a vertical indexer unit 33*b*. The whole structure 52 is standing on bottom plates 36 and so that it is held in position against heat exchanger 30. If the indexer units are moved over a longer distance, the connections of the flexible guiding hoses 34 are loosened periodically at one side and fixed again at that side to reduce torsional tensions in the guiding hoses 34.

Figure 11:
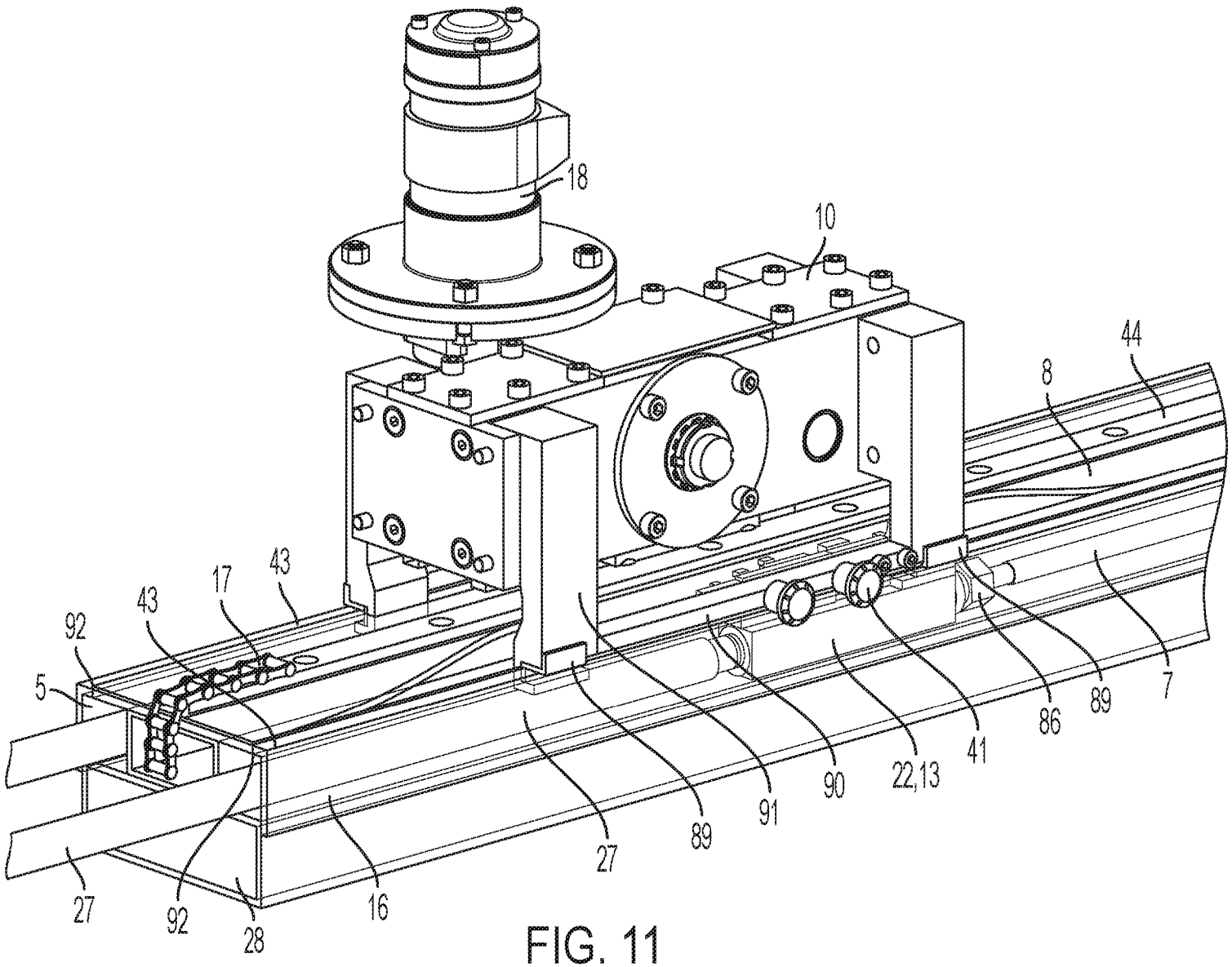
FIG. 11 is a schematic perspective view of a fourth embodiment with a transversal drive, which is bearing lance anchors of FIG. 7B and with high-pressure hoses, which are connected to an external rotational drive.
Figure 12:
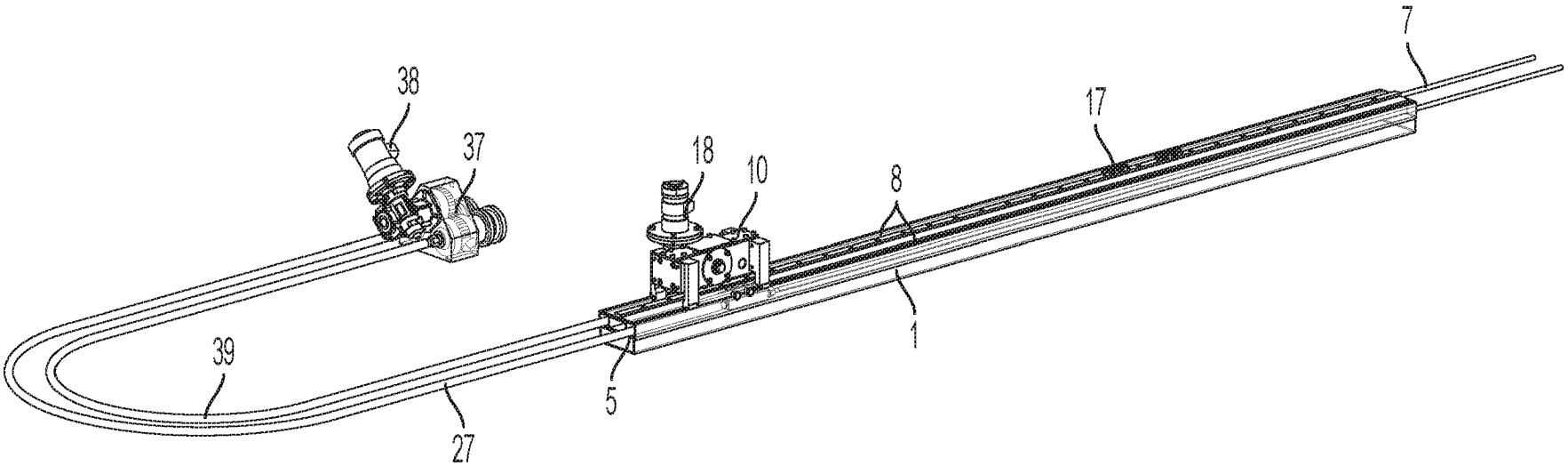
FIG. 12 is a schematic perspective view showing the transversal drive of FIG. 11 on the guide way with high-pressure hoses in a loop to the external rotational drive.

FIGS. 11 and 12 show an embodiment with an external rotational drive 37 and water supply. In FIG. 11, the outer side walls 16 of the guide way 1 show a rectangular balcony 92 for the upper track 43 towards inside, which becomes important for a modified transversal drive 10. The transversal drive 10 has two pillars 91 at each side, which enclose that balcony 92 with bearings 89 for transversal gliding. As also shown on one side the pillars 91 act as deflectors holding the lip 8 upwards. The chain 17 (chain attachment not shown) is coupled to a front plate 28 of the guide way 1 and serves as resistance for pulling the lance anchor 22 forward by means of the air motor 18. The two pillars 91 are solidly connected by a crossbar 90, which is holding a lance anchor 22 and connector 13 in accordance with the configuration shown in FIG. 7B. At one side of the transversal drive 10 a flexible high-pressure hose lance 7 is fixed with a camlock fixation 86. This enables use of the intermediate section 35 with flexible guiding hoses 34 as shown in FIG. 10. At the other side of the transversal drive 10, the connector 13 is connected to a high-pressure hose 27, which comes from the external rotational drive 37 and air motor 38 (see FIG. 12). In FIG. 12 the high-pressure hoses 27 are lying in a loop 39 for being drawn into the channel 5 during advance of the lance 7. Two hand-operated screws 41 at the crossbar 90 hold the lance anchor 22, which ends at the top with a vertical metal sheet (not shown). The screws 41 make it easy to detach the lance anchor 22, to move the transversal drive away and to change lances 7.

Figure 13:
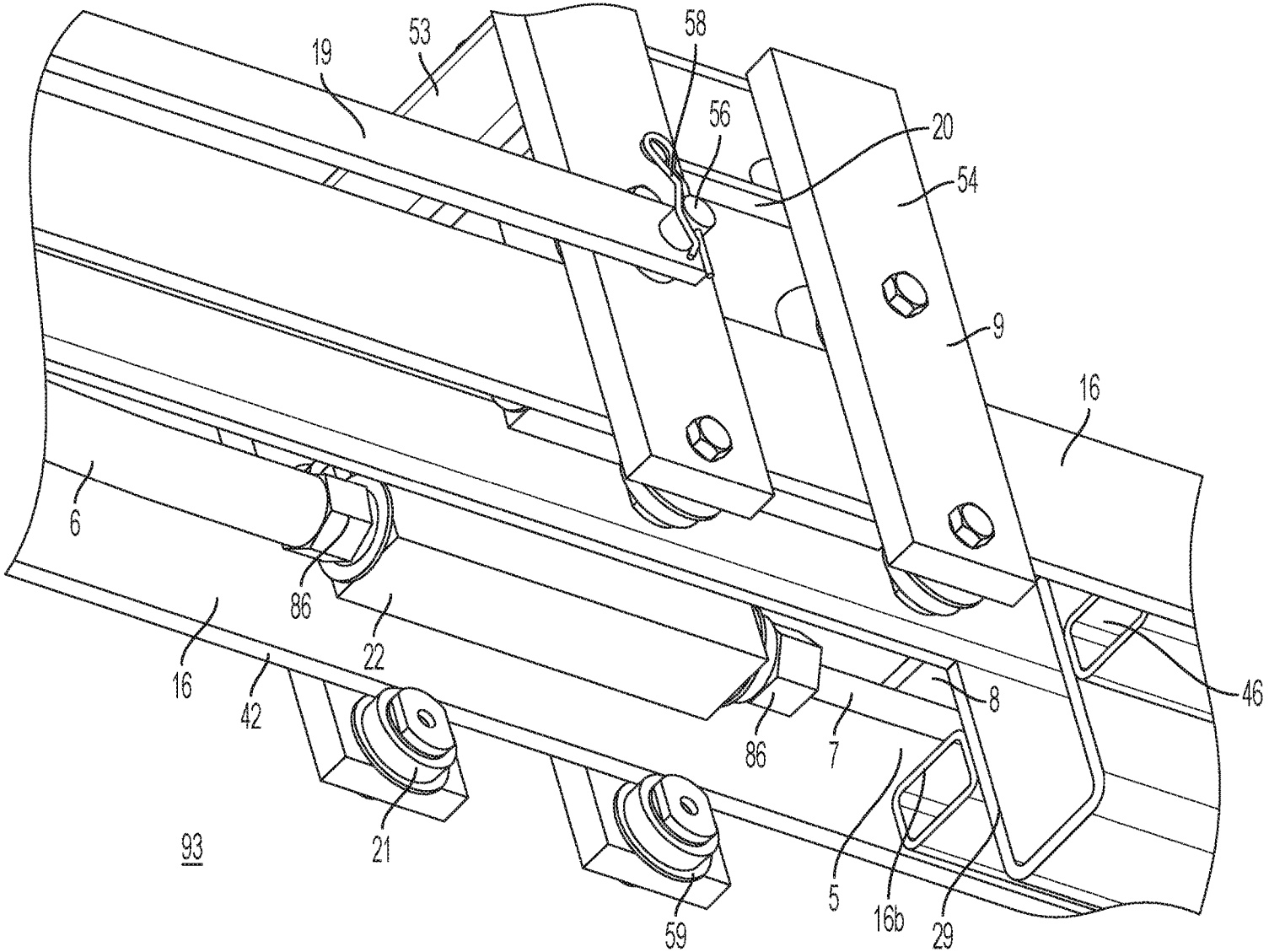
FIG. 13 is a schematic perspective view from below showing a start- and service section on the guide way with the lance anchor carriage of FIG. 6 and a lance anchor of FIG. 7B.

FIG. 13 shows a start and service section 93 where hoses, lances, and/or other components of the lancing machine may be accessed for service and/or repair, including in the field. The start and service section can be used for the described embodiments having a lance anchor 22 and a connector 13 to change lances 7 and to connect hoses 6, 27. The example shows a lance anchor 22 with a lance anchor carriage 9 as described with reference to FIG. 6A. Parts of the main profile 29 and the profiles 46 are not shown in FIG. 13. The outer side walls 16 carry the lance anchor carriage 9. The lip 8 is not positioned (e.g., removed) in the start and service section 93 to provide better access to and visibility of lance 7 and other components, for service, maintenance, and/or replacement.

FIGS. 14, 15A, 15B, 16A, 16B, 17, 18 show the application of horizontal and vertical rubber or rubberlike lip stripes 102, 103. Lip stripes 102, 103 maintain lance 7 in its position in the channel should lance 7 begin to buckle. Deflectors 23 bend lip stripes 102, 103 to create openings for entry of lance 7 in the channel.

Figure 14:
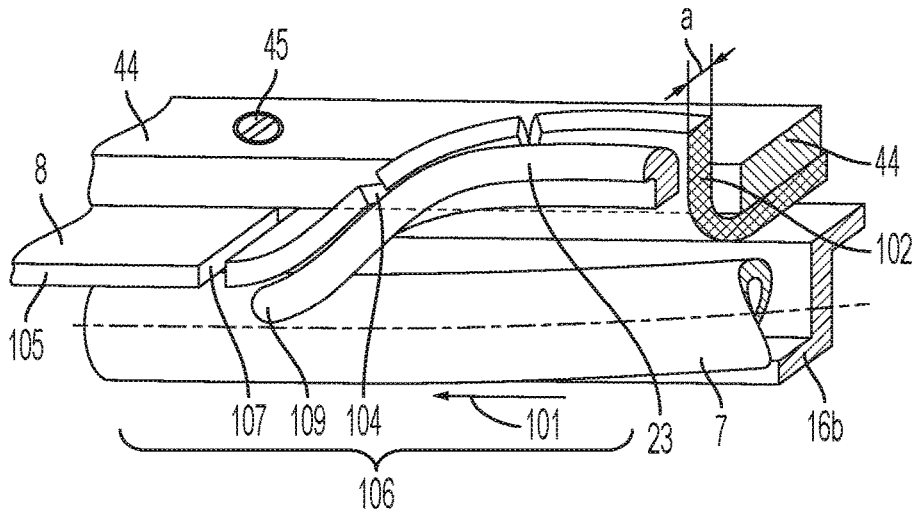
FIG. 14 is a schematic perspective view in section of a deflector with an initial bending zone for vertical bending of horizontal lip stripes.

FIG. 14 shows a section, where a deflector 23 is diving with its tip 109 below the seam 105 of a horizontal lip piece 102 for guiding it into a vertical position. Though there is the rotating cylindrical lance 7 in the channel 5, deflector 23 does not contact the lance 7. Regardless, both elements drive with the same speed in advance direction 101. The lip 8 has incisions 107 or is totally cut into horizontally arranged lip pieces 103 (as shown in FIG. 2C), which open intermediate crevasses 104 to lower the tension in the seam 105 of the lip 8. Without these crevasses 104 a continuous lip 8 develops large tensile forces, which produces high pressure on and friction against the deflector 23 during an initial bending of, for example, 90°. If the stripes would be vertically oriented (as in the embodiment of FIG. 2C), these tensile forces would be entirely omitted.

Varying friction at the deflectors 23 influences the fine tuning of the advance movement of the head of the lance. Omitting for a moment the above tensile forces for the horizontal lip stripes 102 a comparison can be made, which is valid for the entire length of a deflector 23.

Figure 15A:
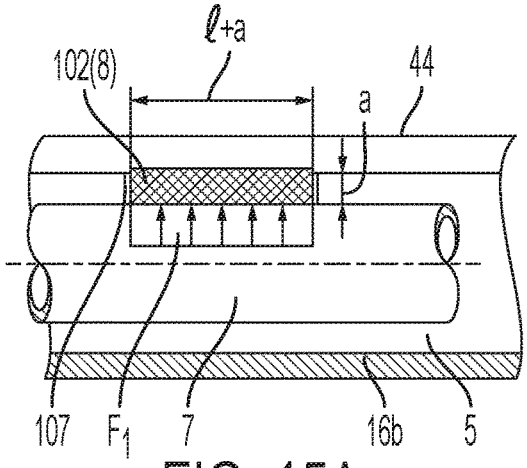
FIG. 15A is a schematic sectional side view of a horizontal lip stripe in contact with the lance.
Figure 15B:
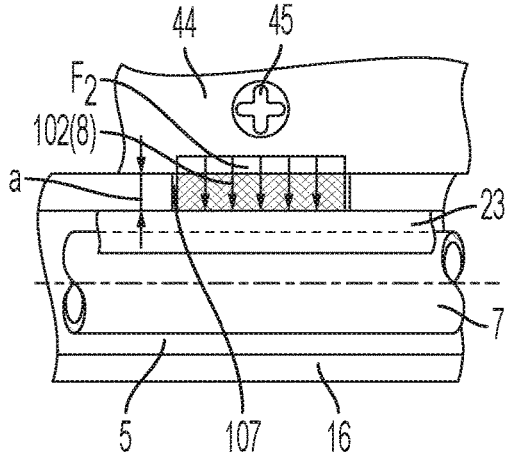
FIG. 15B is a schematic sectional top view of a horizontal lip stripe, which is bent vertically and in contact with a deflector.

FIG. 15A shows a section of a channel 5 with the lance 7 inside, which is pressing against a horizontal lip stripe 102. FIG. 16A also shows a section of a channel 5 with the lance 7 inside, which is pressing against a vertical lip stripe 103. Both lip stripes are equally spaced over the total length of the channel 5. A section of the vertical lip stripes 103 (see FIG. 16A) is at a distance L=l+a, where "l" is the space between two neighboured vertical lip stripes 103 and "a" is the thickness of a lip stripe. The length of the horizontal lip stripe 102 (FIG. 15A) is as well L=l+a. In FIG. 15B and FIG. 16B the cross sections of the horizontal lip stripe 102 and of the vertical lip stripe 103 are shown, which should resist to the same escape force $F_1$ of the lance.

For the horizontal lip stripe 102 (FIG. 15A) the bending resistance is proportional to the geometrical moment of inertia:

$$I=\tfrac{1}{12}\cdot(l+a)\cdot a^3$$

Whereas for the vertical lip stripe 103 (FIG. 16A) the bending resistance is proportional to the geometrical moment of inertia:

$$I=\tfrac{1}{12}\cdot a\cdot h^3$$

Defining for both cases the width of the channel with l=4 a, a comparison can be made to find out the height h of the vertical lip stripe 103, which resists as much as the horizontal lip stripe 103 to the same escape force $F_1$.

$$\tfrac{1}{12}\cdot a\cdot h^3=\tfrac{1}{12}\cdot(l+a)\cdot a^3\rightarrow h=a\cdot 5^{1/3}\rightarrow h=\text{about } 1.7a$$

When the vertical lip stripe 103 has been bent about 90° by the deflector 23, the force against the deflector corresponds to h=about 1.7 a, whereas the force of the horizontal lip stripe 102 corresponds to L=5 a. This means, that the bending forces and friction forces of the vertical lip stripes 103 over the length of the deflector are about one third (1.7/5) of those from the horizontal lip stripes 102. And even during the initial 90° bending of the vertical lip stripe 103 the forces are about one third of those that would be on the horizontal lip stripes 102.

Figure 17:
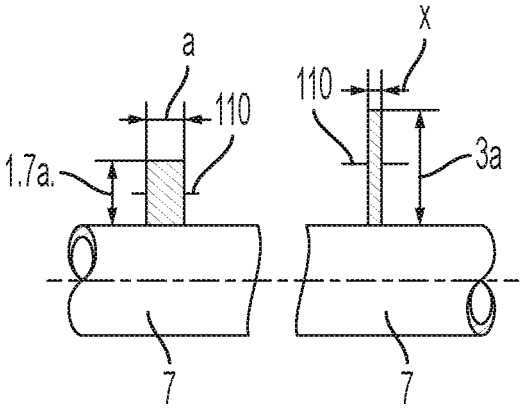
FIG. 17 is a schematic cross section of two vertical lip stripes with different heights.

FIG. 17 shows the cross section of two vertical lip stripes 103 with their neutral axis 110 for bending. The first one is the abovementioned lip stripe 103 with a height of 1.7a and with a thickness a. The second is supposed to have a height of 3 a for finding out what the corresponding thickness x would be to withstand the same bending force:

$$\tfrac{1}{12}\cdot(1.7a)^3\cdot a=\tfrac{1}{12}\cdot(3a)^3\cdot x\rightarrow x=(1.7/3)^3\cdot a\rightarrow x=0.18a$$

Theoretically the thickness would here be reduced to 20% of a, but attention has to be made to how much this lip stripe will resist to a lance in advance direction.

FIG. 18 shows the initial 90° bending of a vertical lip stripe 103, where the friction forces to a deflector 23 can be ameliorated by a diverting roller 108 running with a conventional bearing on the deflector. The diverting roller 108 is extending a little more towards the lip to assist with the elastic deformation of the vertical lip stripe 103 into position for sliding along guiding wall 112 in both direction 101 and the opposite of direction 101. The structure of the lip material is also important. A rubberlike lip material with textile fibers or cloth 111 embedded in the middle plane will generate much more stiffness towards the lance 7, but scarcely more resistance to the diverting roller 108, as the fibers lie in a neutral bending area.

Figure 19:
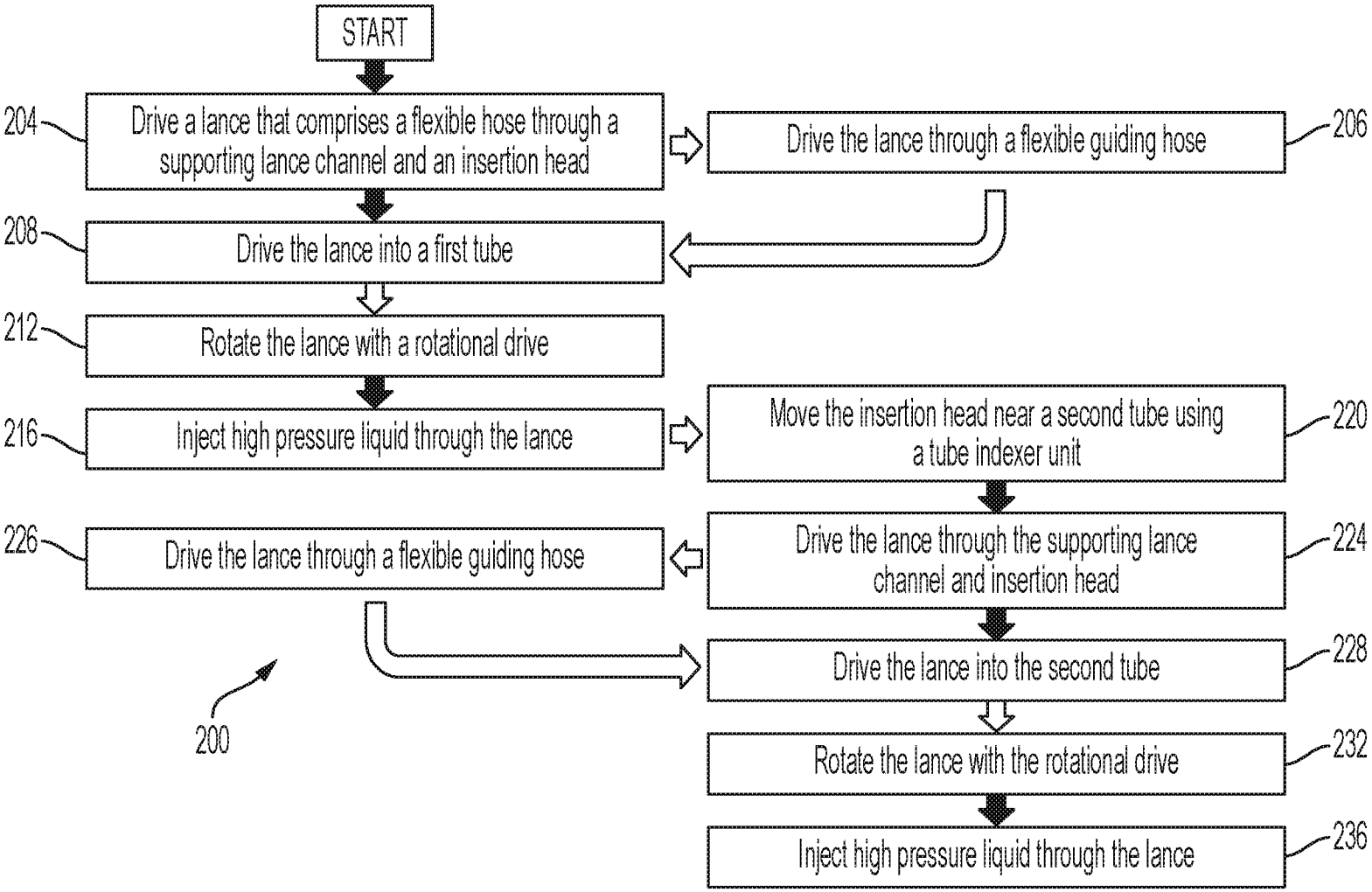
FIG. 19 is a flow chart illustrating a method for using a tube lancing machine according to some embodiments of the disclosure.

FIG. 19 depicts a flow chart illustrating a method 200 of using a tube lancing machine such as the tube lancing machines described herein. At step 204, a lance comprising a flexible hose, such as lance 7, is driven through a supporting lance channel, such as supporting lance channel 5 and through an insertion head, such as insertion head 26. The insertion head may be supported on a structure, such as structure 52, that positions the insertion head near (e.g., in front of an opening of) a first tube, such as a tube of a heat exchanger, such as heat exchanger 30. The lance may be driven by, for example, a transversal drive, such as transversal drive 10, that may be supported by a transversal drive support, such as transversal drive support 3. The lance may be supported in the supporting lance channel of a guide way, such as guide way 1, by a lance anchor, such as lance anchor 22, which may include a connector or rotational tube, such as connector 13 or rotational tube 15, that couples the lance to a flexible high-pressure hose, such as hose 27. The supporting lance channel may including a flexible lip, such as flexible lip 8, that may have lip stripes such as lip stripes 102 or 103, and may permit the flexible hose of the lance to be bent and inserted at an angle relative to the bottom of the supporting lance channel, such as angle "a", as the lance is driven through the supporting lance channel and through the insertion head.

At step 208, the lance may be driven (e.g., with a transversal drive) into the first tube, for example, for the purpose of cleaning the first tube. Before driving the lance into the first tube at step 208, an optional intermediate step 206 may be performed in which the lance is, in addition to the supporting lance channel and insertion head, driven through a flexible guiding hose, such as flexible guiding hose 34. The flexible guiding hose may be positioned between the supporting lance channel and the insertion head such that the lance is driven first through the supporting lance channel, then through the flexible guiding hose, and then through the insertion head before being driven in the first tube at step 208. The flexible guiding hose may be long enough so that repositioning of the insertion head near a second tube (as described below) may be performed without moving the supporting lance channel relative to the first and second tubes.

At step 212, the lance is optionally rotated with a rotational drive, such as rotational drive 4. Step 212 may be performed prior to or concurrent with any or all of steps 204, 206, and 208. Due in part to the flexible natures of the lance, the lance may be rotated at significant speeds and driven at high pressures into tubes, such as first tube, without breaking the lance.

At step 216, high pressure liquid, such as water or flushing liquid, is injected through the lance to, for example, clean the tube (e.g., by using the high pressure liquid to generate water jets that clean the inner walls of the tube). After injection of the liquid, the lance may be removed from the first tube. If it is desired to clean a second tube, then, at step 220, the insertion head may optionally be moved near (e.g., in front of an opening of) the second tube using, for example, a tube indexer having, for example tube indexer units, such as tube indexer units 33*a*, 33*b*. Then the steps just recited may be repeated for the second tube, such that, at step 224, the lance is driven through the supporting lance channel and insertion head and, optionally at step 226, through the flexible guiding hose; at step 228, the lance is driven into the second tube; at step 232, the lance is optionally rotated with a rotational drive; and at step 236, more high pressure liquid is injected through the lance to, for example, clean the second tube. Method 200 may be continued to, for example, clean any number of tubes of, for example, a heat exchanger and advantageously permits fast, efficient, and powerful tube lancing in a confined space without requiring large supporting equipment and without significant risk of breaking lances. The method 200 may be used with the embodiments of the lancing machines described herein, including those having employing more than one lance and more than one supporting lance channel.

The described methods are generally set forth in a logical flow of steps. As such, the described order and labeled steps of representative figures are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Although the present disclosure and certain representative advantages have been described in detail, it should be understood that various changes, substitutions and alterations can be made herein without departing from the spirit and scope of the disclosure as defined by the appended claims. Although numeral identifiers may be inserted in the appended claims, such numeral identifiers merely identify examples from the disclosed embodiments and are not intended to limit the scope of the claims to particular disclosed embodiments. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A machine comprising:

a lance, the lance configured to clean insides of tubes;

a guide way positioned near the tubes;

a transversal drive support slidable on the guide way and configured to move the lance along the guide way towards an insertion head;

a rotational drive coupled to the lance for controlling rotation of the lance; and a feeding system coupled to the lance, wherein the guide way forms at least one supporting lance channel over a length of the guide way, the at least one channel forming an enclosure from all sides for guiding the lance, whereby a part on the circumference of the enclosure is made of a flexible lip, which lip can be locally bent by deflectors travelling with the lance.

2. The machine of claim 1, further comprising a second lance configured to move along the guide way in a second channel.

3. The machine of claim 1, further comprising a rotational drive carriage coupled to the transversal drive support and configured to receive transversal pushing forces from the transversal drive support through connecting pieces that are slidable on the guide way.

4. The machine of claim 1, wherein the rotational drive further comprises:

a swivel configured to transform a stationary feed into a rotatable feed tube; and a motor with a gear box for rotating the rotatable feed tube, the rotatable feed tube ending in an end piece with a connection configured to couple to the lance, the lance comprising a flexible hose, wherein the insertion head comprises a tube indexer configured to adapt a lateral distance of the lance to a lateral distance of a tube to be cleaned.

5. The machine of claim 4, wherein the lance is directed at an angle to a bottom of the at least one channel and bent to follow the at least one channel to the insertion head.

6. The machine of claim 4, wherein the lance is directed at an angle to a bottom of the at least one channel and bent to be guided into the at least one channel by a rotatable pipe, wherein the rotatable pipe is axially supported by bearings in a lance anchor coupled to a lance anchor carriage, which is transversally coupled to the transversal drive support by guiding pieces and which is configured to be slidable on the guide way, and wherein the lance is configured to pass from an end of the at least one channel into the insertion head.

7. The machine of claim 4, further comprising a lance anchor carriage configured to be slidable on the guide way and having transversal coupling bars coupling the lance anchor carriage to the transversal drive support, the lance anchor carriage coupled to a lance anchor in the at least one channel, the lance anchor supporting an axially rotatable connector with bearings.

8. The machine of claim 7, wherein the rotatable connector comprises a first coupling means on a first end for coupling the rotatable connector to a flexible hose and a second coupling means on a second end for coupling the rotatable connector to the lance.

9. The machine of claim 7, further comprising a flexible guiding hose configured to guide the lance and be connected between an end of the at least one channel and the inserting head, wherein the flexible guiding hose is further configured to maneuver the inserting head with the tube indexer without changing the position of the guide way relative to the tubes.

10. The machine of claim 1, further comprising a transversal drive support supporting a lance anchor in the at least one channel, the lance anchor supporting an axially rotatable connector with bearings, wherein the rotatable connector comprises a first coupling means on a first end for coupling the rotatable connector to a flexible hose and a second coupling means on a second end for coupling the rotatable connector to the lance, wherein the lance is configured to pass from an end of the at least one channel into the insertion head, wherein the insertion head comprises a tube indexer configured to adapt a lateral distance of the lance to a lateral distance of a tube to be cleaned.

11. The machine of claim 10, further comprising:

an external rotational drive comprising a swivel configured to transform a stationary feed into a rotatable feed tube; and an air motor with gear box for rotating the rotatable feed tube, the rotatable feed tube ending in an end piece with a connection configured to couple to the flexible hose.

12. The machine of claim 10, further comprising a flexible guiding hose configured to guide the lance and be connected between an end of the at least one channel and the inserting head, wherein the flexible guiding hose is further configured to maneuver the inserting head with the tube indexer without changing the position of the guide way relative to the tubes.

13. The machine of claim 1, wherein the at least one channel of the guide way is formed by a bottom surface of the flexible lip, an exterior top surface of a first rigid beam, an exterior side surface of a second rigid beam, and an interior side surface of a wall.

14. The machine of claim 13, wherein the guide way further comprises a start and service section where portions of the flexible lip, the first rigid beam, and the second rigid beam are not present, such that an interior of the guide way may be accessed.

15. The machine of claim 1, wherein the flexible lip comprises incisions or horizontally or vertically-oriented lip stripes configured to reduce friction with one or more deflectors created when the lance is advanced in the at least one channel.

16. The machine of claim 15, wherein the flexible lip comprises horizontally-oriented lip stripes and the horizontally-oriented lip stripes are spaced apart from each other and clamped at points along the guide way to reduce friction against deflectors present during initial vertical bending at an initial vertical bending zone of the deflectors present.

17. The machine of claim 15, wherein the flexible lip comprises vertically-oriented lip stripes and the vertically-oriented lip stripes are spaced apart from each other and coupled at points along the guide way to reduce the friction against the deflectors when the vertically-oriented lip stripes are bent horizontally.

18. The machine of claim 1, wherein the lance comprises a flexible hose.

19. A method of using the machine of claim 1, the method comprising:

driving the lance through the at least one supporting lance channel and insertion head and into a first tube with the transversal drive support;

rotating the lance with the rotational drive;

injecting liquid through the lance; and moving the insertion head to a second tube using a tube indexer unit, wherein the lance comprises a flexible hose.

20. The method of claim 19, further comprising bending the flexible hose of the lance as it is driven through the at least one supporting lance channel.

* * * * *